United States Patent [19]

Eskelinen et al.

[11] Patent Number: 4,602,439

[45] Date of Patent: Jul. 29, 1986

[54] METHOD AND APPARATUS FOR SUPPORTING A WEB IN HIGH-SPEED PAPER MACHINES

[75] Inventors: Pekka Eskelinen; Vesa Vuorinen, both of Turku, Finland

[73] Assignee: Valmet OY, Finland

[21] Appl. No.: 714,269

[22] Filed: Mar. 21, 1985

[30] Foreign Application Priority Data

Mar. 22, 1984 [FI] Finland ..... 841167

[51] Int. Cl.[4] ..... F26B 3/04; F26B 13/08

[52] U.S. Cl. ..... 34/23; 34/116; 34/123

[58] Field of Search ..... 34/116, 117, 120, 123, 34/23, 41, 33

[56] References Cited

U.S. PATENT DOCUMENTS

| | | | |
|---|---|---|---|
| 1,595,478 | 8/1926 | Minton | 34/117 |
| 3,388,479 | 6/1968 | Gardner | 34/116 |
| 4,378,639 | 4/1983 | Walker | 34/116 |

*Primary Examiner*—Larry I. Schwartz

*Attorney, Agent, or Firm*—Steinberg & Raskin

[57] ABSTRACT

A method and apparatus for inhibiting or preventing fluttering in a running paper web in a drying section of a paper machine, such as in the area of a twin-wire draw. Air jets are blown into pockets defined by a wire guide roll and wire itself, such air jets issuing from suitably designed and positioned blow boxes to be directed at the side of the wire supporting the web either in a direction towards or opposite from the running direction of the wire, and also at the side of the wire guide roll not supporting the wire, in a direction of the tangent of the guide roll. An air jet may also be blown into the pocket defined by the wire guide roll and the wire itself, at the side of the wire running free, not supporting any web, such air jet being directed substantially perpendicular to the wire. Fluttering of the paper web and drawbacks resulting from the same, such as wrinkles and breaks in the web, are inhibited or prevented.

6 Claims, 4 Drawing Figures

METHOD AND APPARATUS FOR SUPPORTING A WEB IN HIGH-SPEED PAPER MACHINES

BACKGROUND OF THE INVENTION

The present invention is directed to a method for inhibiting or preventing fluttering of a paper web passing through the drying section of a paper machine, within the area of a twin-wire draw.

The present invention is also directed to apparatus for carrying out the method, the apparatus including blow or nozzle boxes placed in the pockets formed by the wire-guide rolls and the wires themselves, and extending substantially over the entire transverse width of the web.

Running speeds of paper machine have been constantly increasing in recent years, with speeds being approached of 1500. The fluttering of the web therefore becomes a serious problem, hampering the running quality of the paper machine. The transfer of the web from the press section to the drying section, and the support of the web in an area of a single-wire draw, can be controlled with certain previously-known methods and apparatus. However, in the area of the twin-wire draw, in particular in the third and fourth operating groups of cylinders within a drying section, difficulties have been encountered at high running speed.

As used herein, a single-wire draw is a mode of passing the web over the heated drying cylinders, in which the web runs from one line of cylinders to the other supported by a drying wire, so that the web is between the drying wire and the cylinder surface on one line of cylinders, and on the other line of cylinders, the web is outside and the drying wire is situated between the cylinder surface and the web, with the web being supported by the drying wire in the draws running between the line of cylinders. An advantage of a single-wire draw is that the web is always supported by the drying wire, and there are no open draws at all, or at least no substantially long open draws, which reduces the risk of wrinkles and breaks in the web.

As used herein, a twin-wire draw is a prior-art mode of supporting and passing the web in conjunction with heated drying cylinders, in which an upper wire is used in conjunction with the upper cylinders and a lower wire is used in conjunction with the lower cylinders. These wires are guided by the surfaces of the drying cylinders and by the guide rolls placed between the drying cylinders, so that, on the upper line of cylinders, the web is pressed by the upper wire into direct drying contact with the surfaces of the upper cylinders, and, correspondingly, into drying contact with the surfaces of the lower cylinders, by the lower wire.

In the twin-wire draw, the web has generally had substantially long open draws when running from one line of cylinders to the other. These open draws have been subject to fluttering, resulting in breaks and wrinkles in the web. This drawback has been accentuated in the initial portion of the drying section, where the web is still relatively moist and therefore of low strength, with elastic properties conducive to fluttering.

Attempts have been made to eliminate this drawback by shortening the open draws of the web in the inital portion of the drying section, by placing the imaginary planes passing through the axis of the upper and lower line of cylinders at a distance from one another that is shorter than customary, or shorter than what would be optimal, e.g., in view of the efficiency of drying.

The possibility of providing the third and fourth drying groups of cylinders with a single-wire draw, has also been considered. However, this has been an exigent solution, because it results in a lowered evaporation efficiency and makes the arrangement of air conditioning more difficult.

Attempts have been made to reduce the fluttering of the paper-web in a drying section provided with a twin-wire draw, by shifting the felt guide rolls so that the paper-web runs a shorter distance without support. In U.S. Pat. No. 3,753,298, such a drying section is described. According to the paper "Engineering Consideration for Lightweight Paper Drying in High Speed Machines" (*Paper Technology and Industry,* July/August, 1978), the positioning of the rolls in accordance with U.S. Pat. No. 3,753,298 has been used in a Swedish paper machine, with which a speed of 853 m/min has been attained. However, fluttering of the web has continued to be a difficulty.

The fluttering of the paper-web has been discussed in the publication "Manufacture of Paper", *Textbook and Manual of the Finnish Paper Engineers' Association III, Volume I,* pages 699–700, where it is stated that fluttering of the edge of the web is generally not caused by currents of air, which has been a common belief. Under the circumstances, the fluttering of the web cannot be significantly prevented with guiding of air currents in the drying section, which has, however, been frequently attempted.

SUMMARY OF THE INVENTION

Accordingly it is an object of the present invention, to inhibit or prevent fluttering of a running paper web in the drying section of a paper machine.

It is also an object of the present invention to provide for adequate support of a paper web running through the drying section of a paper machine.

It is another object of the present invention to inhibit or prevent breaks and wrinkles from occuring in a paper web running through the drying section of a paper machine.

It is an additional object of the present invention to permit attainment of high running speeds for a paper web through a drying section of a paper machine, with minimal or no chance of fluttering, wrinkles, and or breakage occuring in the running web.

It is a further object of the present invention to provide for suitable support of a paper web running through a twin-wire draw, so that detrimental fluttering is inhibited or eliminated, especially at high running speeds.

These and other objects which will become apparent herein, are attained by the present invention which provides a method in which jets of gas such as air are blown into pockets defined by guide rolls for the wires and the wires themselves. Such jets of gas are directed at the side of the wire run supporting the web between the drying cylinder and the guide roll, in a direction towards or opposite the running direction of the wire. The gas jets are also directed at the free side of the wire guiding roll, i.e. the portion of the guiding roll not contacting the running wire, substantially in the direction of the tangent of the wire guiding roll.

According to a preferred embodiment of the present invention, gas jets such as air are blown into the pockets defined by the free sides of the wire guide rolls and the wires themselves, on the run of the wire that does not support the web, and that passes from a drying cylinder to the guide roll, with these gas jets being directed substantially perpendicular to the wire facing the gas jets.

Additionally, the present invention provides an apparatus including a nozzle or blow box disposed in the pocket formed by the wire guide roll and the wire itself, and extending substantially over the entire transverse width of the web. This nozzle or blow box has at least two nozzle slots disposed transverse to the running web, one of the nozzle slots being placed at the side of the wire supporting the web, and the other nozzle slot being placed at the side of the wire guide roll.

According to a preferred embodiment of this apparatus in accordance with the present invention, the nozzle or blow box includes a third nozzle slot disposed transverse to the running web, along the free run of the wire, i.e. the run of the wire not supporting the web and passing from the drying cylinder to the guide roll.

With the method and apparatus of the present invention, fluttering of the paper web and the disadvantages resulting therefrom, such as wrinkles and breaks in the web, are effectively inhibited or prevented.

BRIEF DESCRIPTION OF THE DRAWINGS

The invention will be described in further detail below, with reference to the accompanying drawings, to which the present invention however is not intended to be limited. In the drawings.

DETAILED DESCRIPTION OF THE PREFERRED EMBODIMENTS

Figure 1:
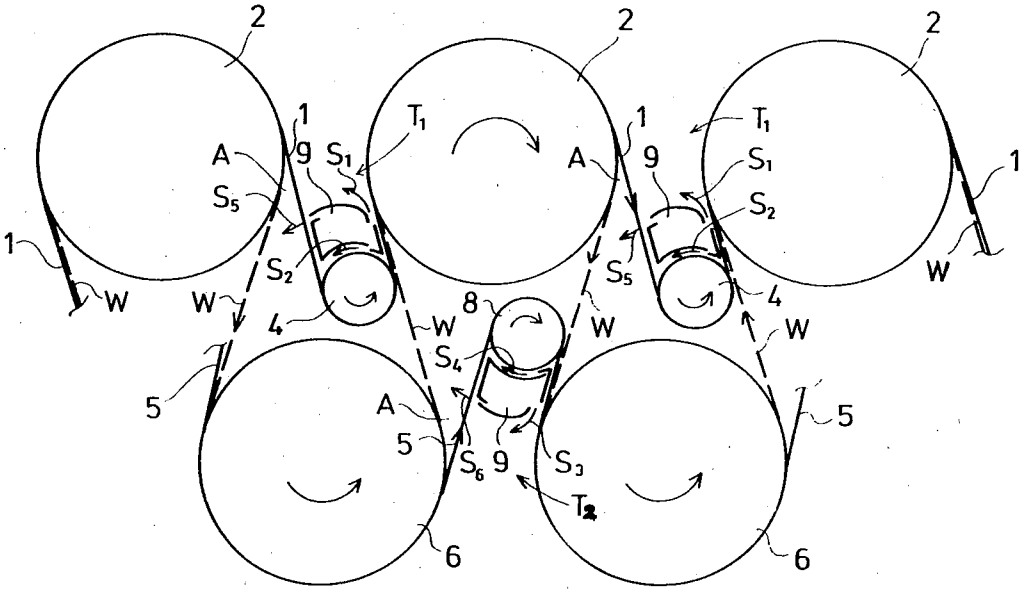
FIG. 1 is an illustration of part of a drying cylinder group provided with a twin-wire draw and utilizing the present invention for supporting the web.

As illustrated in FIG. 1, in the case of a twin-wire draw, the paper web is placed underneath the wires 1,5 both on the upper and on the lower drying cylinders 2,6. The upper wire 1 runs in meandering fashion, as guided by the upper cylinders 2 and by the upper wire guide rolls 4. Correspondingly, the lower wire guide runs as guided by the lower cylinders 6 and by the lower wire guide rolls 8.

Figure 4:
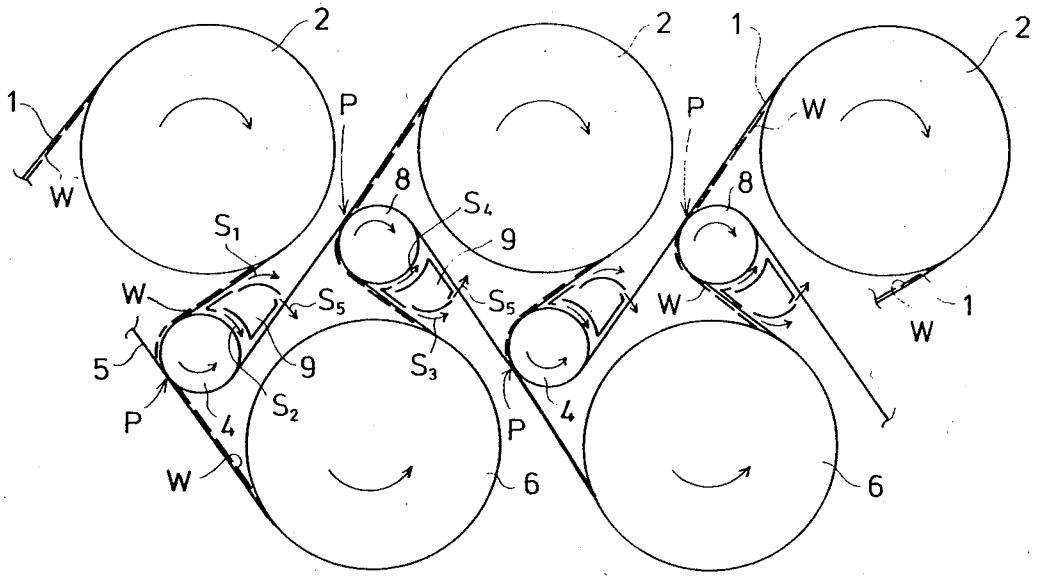

Air jets are blown into the pocket $T_1$ defined by the upper wire 1 and by the wire guide roll 4, the pocket $T_1$ being open at the top thereof as illustrated. The direction of the air jet $S_1$ that is blown at the side of the pocket $T_1$ where the wire 1 supports the web W, is the same as the running direction of the wire 1. Alternatively, as illustrated in FIG. 4 to be discussed further below, the direction of the air jet $S_1$ blown at the side of the pocket $T_1$ where the wire 1 supports the web W, may be opposite to the running direction of the wire 1.

The direction of the air jet $S_2$ that is blown at the side of the wire guide roll 4 as illustrated in FIG. 1, is substantially the same as the direction of the tangent of the roll 4. In both cases, the speed of the air jets $S_1$ and $S_2$ is essentially higher than the speed of the moving surfaces facing the jets.

Correspondingly, air jets $S_3$ and $S_4$ are blown into the pocket $T_2$ defined by the lower wire 5 and by the wire guide roll 8, this pocket $T_2$ being open at the bottom thereof. The air jets $S_3$ and $S_4$ are directed in a similar manner corresponding to the air jets $S_1$ and $S_2$ that are blown into the pocket $T_1$ defined by the upper wire 1. Therefore, the direction of the air jet $S_3$ is the same as, or opposite to (FIG. 4), the running direction of the wire 5 facing the jet. The direction of the air jet $S_4$ that is blown at the side of the wire guide roll 8, is the same as the direction of the tangent of the roll. In these cases as well, the speeds of the air jets $S_3$ and $S_4$ are also greater than the speed of the moving surfaces facing the same.

In addition to the air jets $S_1$, $S_2$, $S_3$, and $S_4$, an air jet $S_5$ may be blown into the pocket $T_1$ defined by the upper wire guide roll 4 and the wire 1, at the side of the wire 1 that is running free, i.e. not supporting any paper web. In similar fashion, an air jet $S_6$ may be blown into the pocket $T_2$ defined by the lower wire guide roll 8 and the wire 5, at the side of the wire 5 that is running free. These air jets $S_5$ and $S_6$ are directed substantially perpendicularly to the runs of the respective wires 1 and 5.

Support contact between the respective wire 1, 5 and the paper web W, is improved even further with the air jets $S_5$ and $S_6$.

By way of the generated ejection effect, the air jets $S_1$, $S_2$, $S_3$, and $S_4$ produce a negative pressure at the side of the wire pocket where the respective wire 1, 5 supports the paper web W. Since the wire fabric 1, 5 is permeable to air, while the paper web is substantially impermeable to air, the negative pressure generated in this fashion improves the supporting contact between the respective wires 1, 5 and the paper web W.

The air blown by way of these air jets $S_1$–$S_6$ gathers at the side of the respective wire pockets $T_1$ and $T_2$ where the wire 1, 5 runs alone, i.e. does not contact any web. Thus, a zone of positive pressure is produced in proximity to the wire 1, 5. Additionally, pumping by the moving wire 1, 5 also generates positive pressure within this zone. The pressurized air flows through the wire 1, 5 into the space A as illustrated in FIG. 1, where a positive pressure is also generated. This also improves supporting contact between the wire and the running paper web.

Figure 2:
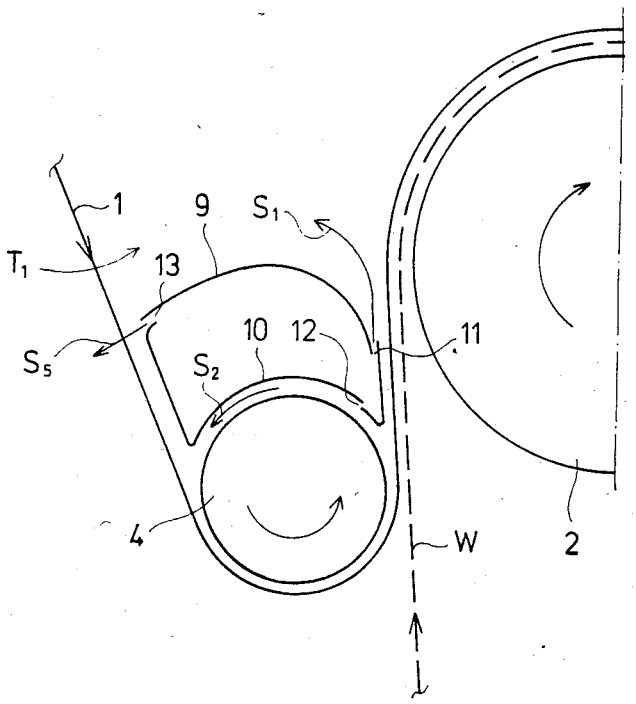
FIG. 2 illustrates one pocket defined by a running wire and a wire guide roll, in which apparatus in accordance with the present invention is disposed.

Apparatus in accordance with the present invention is illustrated on an enlarged scale in FIG. 2. The apparatus includes a nozzle or blow box 9, provided with at least two nozzle slots 11 and 12. The nozzle or blow box extends close to the wire guide roll 4 and close to the wire 1, at both sides of the wire pocket $T_1$, as illustrated in FIG. 2. The side wall 10 of the blow box 9, situated adjacent to the guide roll 4, is shaped to follow a curved form of the roll 4 as illustrated. The nozzle slot 11, situated at the side of the wire 1 that is supporting the running web W, is situated along this particular run of the wire 1 approximately half way between the guide roll 4 and the upper drying cylinder 2. The nozzle slot 12 which is situated at the free side of the wire guide roll 4, i.e. the portion of the guide roll not contacting any wire 1, is placed near the bottom of the gap (wedge space) formed by the guide roll 4 and the run of the wire 1 that is supporting the web W, as illustrated. Both of the nozzle slots 11, 12 are shaped so that the air jets $S_1$ and $S_2$ (denoted in FIG. 1), attain the starting directions described above.

Past the nozzle slot 11, the top wall of the blow box 9 curves gradually towards the free run of wire 1. The curved wall promotes the turning of the air jet $S_1$, and the gathering of air at the side of the wire 1 that is running alone, i.e. running free without supporting any running web, in the wire pocket $T_1$.

In certain cases, a jet of air may also be blown directly at the side of the wire 1 that is running free. In such a case, a third nozzle slot 13 is disposed as far from the wire guide roll 4 as possible. The nozzle slot 13 is shaped so that the jet $S_5$ (denoted in FIG. 1), is directed substantially perpendicularly to the free run of the wire 1, as illustrated in FIG. 2.

The blow box 9 disposed proximate to the lower wire guide roll 8 and the lower wire 5, may also be correspondingly provided with a third nozzle slot 13. In such a case, this nozzle slot is also disposed as far as possible from the wire guide 9 roll 8, and is shaped so that the air jet $S_6$, blown out thereof, is directed substantially perpendicularly to the free run of the wire 5.

The blow boxes 9 described above, extend over substantially the entire width of the web W in the transverse direction of the paper machine. The blow boxes 9 are provided with closed ends. One or both of these ends may be provided with ducts that are known in and of themselves, through which the air is directed into the blow boxes 9 out from blowing devices also known in and of themselves. Such blowing devices, if necessary, may include means by which pressure level of the air to be blown can be controlled.

The pockets $T_1$ and $T_2$ are open at the top when formed in conjunction with the upper cylinders 2, and open at the bottom when formed in conjunction with the lower cylinders 6. If it is desired to increase the pressure level within these pockets $T_1$, $T_2$, these pockets may be at least partially closed by means of walls or other arrangements, which may be placed, e.g., in the spaces between adjacent cylinders 2 or adjacent cylinders 6, at or proximate to the imaginary plane passing through the axis of these respective upper or lower cylinders.

With the present invention, the air jets $S_1$–$S_6$ may be blown, with the blow boxes 9 being concomitantly used, in all or some of the drying cylinder groups in which a twin-wire draw is used. If a twin-wire draw is used at the final end of the drying section, then the present invention can be advantageously applied in one or some of the first twin-wire draw groups only. The present invention is especially advantageously applied in the third and fourth, and possibly in one or several of the succeeding operating groups, when a single-wire draw is applied in the first and second operating groups of cylinders of a drying section.

Figure 3:
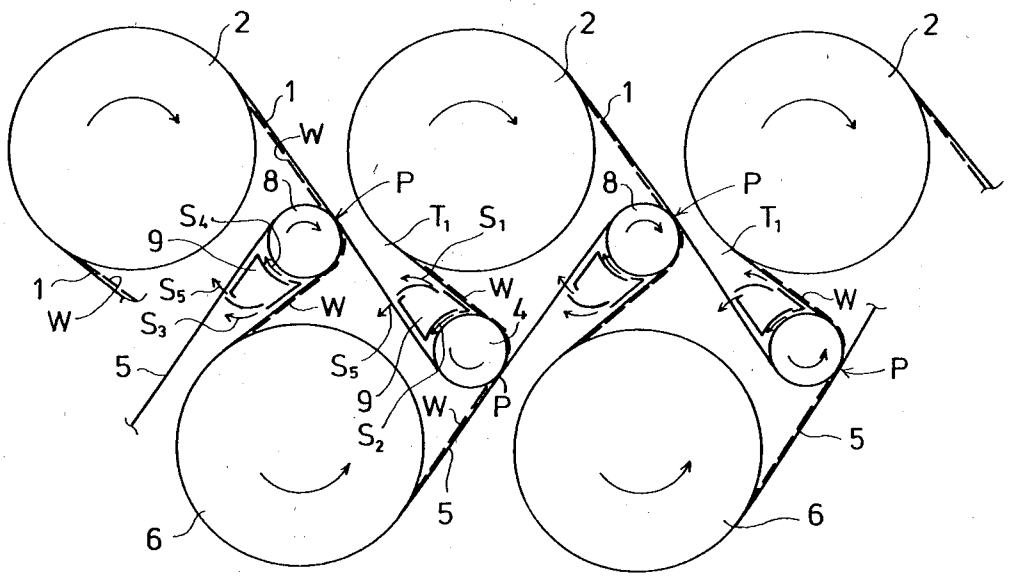
FIGS. 3 and 4 illustrate a portion of a drying cylinder group provided with a twin-wire draw, in which the wire guide rolls have been shifted in the longitudinal direction of the paper machine, in order to support the running paper web over as long a distance as possible, in accordance with the present invention.

In the twin-wire draw illustrated in FIGS. 3 and 4, the wire guide rolls have been shifted in longitudinal direction of the paper machine, i.e. in the running direction of the wire 1 and web W, in order for the paper web W to be supported on the wires 1 or 5, over as long a distance as possible. In the drying sections illustrated in FIGS. 3 and 4, the present invention operates even more efficiently than in the drying section illustrated in FIG. 1. In the drying sections of FIGS. 3 and 4, the negative pressure zone, which improves the supporting contact between the respective wires 1, 5 and the web W, can be made quite long.

In the embodiment of the present invention illustrated in FIGS. 1 and 2, the web W will have free runs as the web passes from the line of upper cylinders 2 to the line of lower cylinders 6, and vice versa. However, it has been possible to make these free runs or draws substantially shorter by appropriately positioning the guide rolls 4 and 8. It is also possible to make the running of the web W more reliable, by means of the jets of air $S_1$–$S_6$, and the blow boxes 9, in accordance with the present invention.

In the embodiments of the present invention illustrated in FIGS. 3 and 4, the web W runs from the upper line of cylinders 2 to the lower line of cylinders 6, and vice versa, always being supported by one of the drying wires 1 and 5. The web W is shifted from support of one of the wires, e.g. the first wire 1, to support by the second wire 5, and vice versa, at the respective guide rolls 8, 4, within the region denoted by the letter P in FIGS. 3 and 4 respectively.

In FIG. 3, the respective jets of air $S_1$, $S_3$, are directed in a direction substantially the same as the running direction of the respective wires 1, 5, with the running web W being shifted to a respective wire 1, 5 that is passing about the respective guide roll 4,8 as illustrated. In FIG. 4, the air jets $S_1$, $S_3$ are directed substantially opposite to the running direction of the wire 1 supporting the web W, with the web W being shifted from the respective wire 1, 5 passing about the respective guide roll 4–8, to the other wire 1, 5 as illustrated in FIG. 4. Also, as illustrated in this figure, the jets of air $S_2$, $S_4$, are blown substantially opposite to the direction of rotation of respective guide rolls 4, 8, unlike the direction of the air jets $S_2$, $S_4$ in the previously illustrated embodiments, which are in the direction of rotation of the respective guide rolls 4, 8.

The preceding description of the present invention is merely illustrative, and is not intended to limit the scope thereof in any way.

What is claimed is:

1. In a drying section of a paper machine including a twin-wire draw operating group including upper and lower lines of drying cylinders wherein a web passes from a drying cylinder of one line to a drying cylinder of another line in direct contact with the drying cylinders, an upper wire guided by said upper drying cylinders and first guide rolls, and a lower wire guided by said lower drying cylinder and second guide rolls so that the web is pressed in direct drying contact with the upper and lower drying cylinders by the upper and lower wires respectively, and wherein each respective wire defines pockets as it runs between adjacent drying cylinders of a line over the guide rolls, each pocket being defined between a first run of the wire from a drying cylinder to a guide roll, a second run of the wire from the guide roll to the next following drying cylinder, and a free surface of the guide roll over which the wire does not run, and wherein the web is supported by the wire over at least a portion of one of said first and second runs and wherein the wire does not support the web over at least a portion of the other one of said first and second runs, a method for preventing fluttering of the web in the drying section comprising the steps of:

directing a first gas jet in a pocket adjacent to said web-supporting wire run in a direction substantially parallel to the running direction of said web-supporting wire run; and at the same time directing a second gas jet in said pocket adjacent to said free surface of the guide roll substantially in a direction of a tangent thereto.

2. The method of claim 1 including the further step of at the same time directing a third gas jet in said pocket against said web-non-supporting wire run in a direction substantially perpendicular to the running direction of said web-non-supporting wire run.

3. The method of claim 1 including the further step of supporting the web on a drying wire over a substantial part of the run of the web between the lines of drying cylinders.

4. The method of claim 1 wherein the drying section includes at least one initial single-wire draw operating group through which the web runs prior to said twin-wire draw operating group.

5. In a drying section of a paper machine including a twin-wire draw operating group including upper and lower lines of drying cylinders wherein a web passes from a drying cylinder of one line to a drying cylinder of another line in direct contact with the drying cylinders, an upper wire guided by said upper drying cylinders and first guide rolls and a lower wire guided by said lower drying cylinders and second guide rolls so that the web is pressed in direct drying contact with the upper and lower drying cylinders by the upper and lower wires respectively, and wherein each respective wire defines pockets as it runs between adjacent drying cylinders of a line over the guide rolls, each pocket being defined between a first run of the wire from a drying cylinder to a guide roll, a second run of the wire from the guide roll to the next following drying cylinder, and a free surface of the guide roll over which the wire does not run, and wherein the web is supported by the wire over at least a portion of one of said first and second runs and wherein the wire does not support the web over at least a portion of the other one of said first and second runs, the improvement comprising:

a blow box situated in a pocket, said blow box having a length extending over substantially the entire width of the web, said blow having first nozzle means transverse to the web for directing a first gas jet in said pocket adjacent to said web-supporting wire run in a direction substantially parallel to the running direction of said web-supporting run, and second nozzle means transverse to the web for directing a second gas jet in said pocket adjacent to said free surface of the guide roll substantially in a direction of a tangent thereto.

6. The combination of claim 5 wherein said blow box includes third nozzle means transverse to the web for directing a third gas jet in said pocket against said web-non-supporting wire run in a direction substantially perpendicular to the running direction of said web-non-supporting wire run.

* * * * *